US009209007B2

(12) United States Patent
Kato et al.

(10) Patent No.: US 9,209,007 B2
(45) Date of Patent: Dec. 8, 2015

(54) SHORT ARC DISCHARGE LAMP

(71) Applicant: USHIO DENKI KABUSHIKI KAISHA, Tokyo (JP)

(72) Inventors: Atsushi Kato, Hyogo (JP); Masataka Mamizuka, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/536,020

(22) Filed: Nov. 7, 2014

(65) Prior Publication Data

US 2015/0137676 A1 May 21, 2015

(30) Foreign Application Priority Data

Nov. 20, 2013 (JP) ..... 2013-239706

(51) Int. Cl.
*H01J 5/16* (2006.01)
*H01J 61/02* (2006.01)

(52) U.S. Cl.
CPC ..... *H01J 61/025* (2013.01)

(58) Field of Classification Search
None
See application file for complete search history.

(56) References Cited

U.S. PATENT DOCUMENTS

| | | | | |
|---|---|---|---|---|
| 5,317,484 | A * | 5/1994 | Davenport et al. | 362/551 |
| 5,418,420 | A * | 5/1995 | Roberts | 313/114 |
| 5,903,088 | A * | 5/1999 | Sugitani et al. | 313/46 |
| 2007/0279916 | A1 * | 12/2007 | Kobayashi | 362/341 |
| 2008/0205063 | A1 * | 8/2008 | Toma et al. | 362/296 |
| 2009/0237941 | A1 * | 9/2009 | Premysler | 362/296.05 |

FOREIGN PATENT DOCUMENTS

JP 2013-016361 A 1/2013

* cited by examiner

*Primary Examiner* — Ashok Patel
(74) *Attorney, Agent, or Firm* — Michael Best & Friedrich LLP

(57) ABSTRACT

A short arc discharge lamp that includes: a body that includes a reflection surface and a front opening, the reflection surface is curved in a concave shape and includes a first reflection surface section having a shape along a first quadric surface of revolution and a second reflection surface section having a shape along a second quadric surface of revolution; a cathode and an anode opposed to each other in discharge space defined by the reflection surface; and a window member covering the front opening. The first reflection surface section has a focal point at a position between the cathode and the anode, and the second reflection surface section is continuous from the first reflection surface section, and has a focal point at a position displaced toward front from the focal point of the first reflection surface section.

7 Claims, 3 Drawing Sheets

SHORT ARC DISCHARGE LAMP

CROSS REFERENCE TO RELATED APPLICATIONS

This application claims the benefit of Japanese Priority Patent Application JP2013-239706 filed on Nov. 20, 2013, the entire contents of which are incorporated herein by reference.

BACKGROUND

The invention relates to a short arc discharge lamp provided therein with a mirror.

One type of a short arc discharge lamp (hereinafter simply referred to as a "discharge lamp") is known in which a mirror is provided therein. Such a discharge lamp includes a lamp body (hereinafter simply referred to as a "body") formed of an opaque insulating member and including therein a reflection surface curved in a concave shape, and only a portion where light is to be extracted is formed of a translucent member. For example, reference is made to Japanese Unexamined Patent Application Publication No. 2013-016361.

Referring to FIG. 5, an exemplary discharge lamp provided therein with a mirror has a body 30 and a window member 40. The body 30 includes therein a reflection surface 31 curved in a concave shape, and the window member 40 covers a front opening of the body 30. The reflection surface 31 defines discharge space S surrounded by the reflection surface 31 and in which a cathode 32 and an anode 33 are disposed to oppose each other.

In FIG. 5, reference numerals 34, 35, 36, 37, 38, 39, and 41 denote a conductive supporting member, a metal block, a ceramic spacer ring, a metal ring that serves to supply power to the cathode 32, a first metal tubular body, a second metal tubular body, and a window supporting member, respectively.

In general, the reflection surface in the body of the discharge lamp is parabolic or the like in cross-sectional shape, and is disposed such that a focal point thereof is located at a gap between the cathode and the anode.

SUMMARY

In a discharge lamp, such as that having a configuration described above, illuminance decreases with the elapse of operating time as compared with illuminance in early stages of operation of the discharge lamp.

It is desirable to provide a short arc discharge lamp capable of suppressing variation between illuminance in early stages of operation of the discharge lamp and illuminance following the elapse of operating time of the discharge lamp.

A short arc discharge lamp according to an embodiment of the invention includes: a body including therein a reflection surface and having a front opening, in which the reflection surface is curved in a concave shape and includes a first reflection surface section and a second reflection surface section, the first reflection surface section has a shape along a first quadric surface of revolution, and the second reflection surface section has a shape along a second quadric surface of revolution; a cathode and an anode that are opposed to each other in discharge space, in which the discharge space is defined by the reflection surface surrounding the discharge space; and a window member provided in front of the body and covering the front opening. The first reflection surface section has a focal point at a position between the cathode and the anode, and the second reflection surface section is continuous from the first reflection surface section, and has a focal point at a position displaced toward front from the focal point of the first reflection surface section.

Advantageously, the focal point of the second reflection surface section may be located at the position corresponding to a consumed tip of the cathode.

Advantageously, the second reflection surface section may be disposed in front of the first reflection surface section.

Advantageously, the body may be configured of an insulating member.

Advantageously, the focal point of the first reflection surface section may be substantially coincident with a luminous spot upon manufacture of the short arc discharge lamp.

Advantageously, the first reflection surface section may have a first parabolic cross-sectional shape, and the second reflection surface section may have a second parabolic cross-sectional shape different from the first parabolic cross-sectional shape.

Advantageously, the first reflection surface section may have a first elliptical cross-sectional shape, and the second reflection surface section may have a second elliptical cross-sectional shape different from the first elliptical cross-sectional shape.

According to the short arc discharge lamp in any of the above-described embodiments of the invention, the reflection surface of the body includes the first reflection surface section and the second reflection surface section. The first reflection surface section has the shape along the first quadric surface of revolution, and has the focal point at a position between the cathode and the anode. The second reflection surface section has the shape along the second quadric surface of revolution, and has the focal point at a position displaced toward the front from the focal point of the first reflection surface section. Thus, when the focal point of the first reflection surface section is defined as being located at a luminous spot in early stages of operation of the discharge lamp, a position of the luminous spot is brought closer to the focal point of the second reflection surface section in the discharge lamp following the elapse of operating time. Hence, although the luminous spot is displaced from the focal point of the first reflection surface section with the elapse of operating time of the discharge lamp, the displaced luminous spot is brought closer to the focal point of the second reflection surface section, or is brought into coincidence with the focal point of the second reflection surface section. As a result, the first reflection surface section mainly receives light derived from the luminous spot in the early stages of operation of the discharge lamp, and the second reflection surface section mainly receives the light derived from the luminous spot in the discharge lamp following the elapse of operating time. Hence, it is possible to suppress the variation between illuminance in the early stages of operation of the discharge lamp and illuminance following the elapse of operating time of the discharge lamp.

Also, in one embodiment where the second reflection surface section is disposed in front of the first reflection surface section, the first reflection surface section is located at a position closer to the cathode and where a greater quantity of light is thus applied. Hence, it is possible to ensure enough illuminance in the early stages of operation of the discharge lamp.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate some example embodiments and, together with the specification, serve to explain the principles of the invention.

DETAILED DESCRIPTION

Some example embodiments of the invention are described in detail below with reference to the accompanying drawings.

Figure 1:
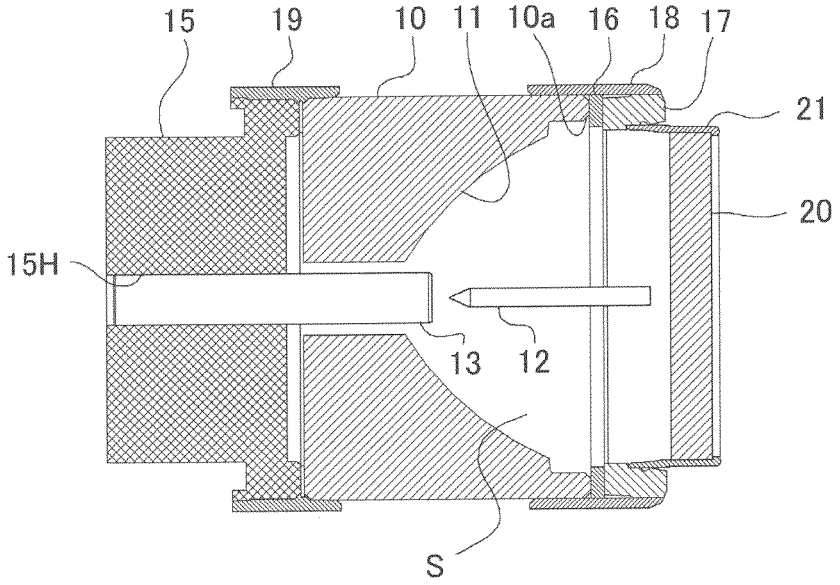
FIG. 1 is a cross-sectional view illustrating an example of a configuration of a short arc discharge lamp according to an embodiment of the invention.
Figure 2:
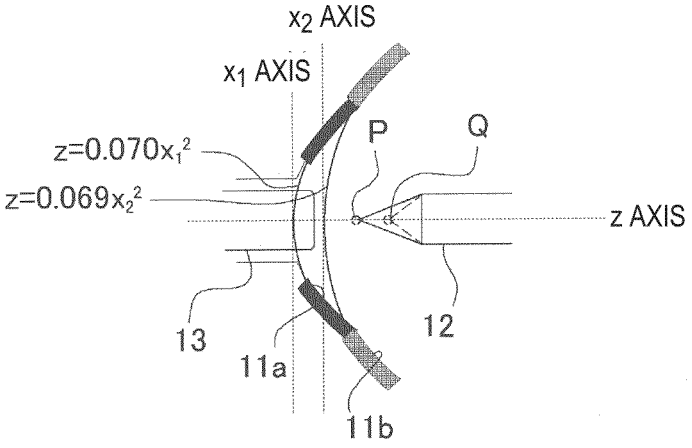
FIG. 2 is a schematic view for describing a first reflection surface section and a second reflection surface section in the short arc discharge lamp illustrated in FIG. 1.

FIG. 1 is a cross-sectional view illustrating an example of a configuration of a short arc discharge lamp (hereinafter simply referred to as a "discharge lamp") according to an embodiment of the invention. FIG. 2 is a schematic view for describing a first reflection surface section and a second reflection surface section in the short arc discharge lamp illustrated in FIG. 1.

The discharge lamp is provided with a body 10 and a window member 20. The body 10 may be cylindrical in outer shape and includes therein a reflection surface 11 curved in a concave shape. The window member 20 covers a front opening 10*a* of the body 10. The reflection surface 11 of the body 10 defines discharge space S surrounded by the reflection surface 11 and in which a cathode 12 and an anode 13 are provided. The cathode 12 and the anode 13 may be disposed to oppose each other with a gap interposed therebetween, and extend along an optical axis of the reflection surface 11. The body 10 may be supported by a metal block 15.

The body 10 may be an insulating member made of a ceramic material such as, but not limited to, polycrystalline alumina ($Al_2O_3$).

The reflection surface 11 of the body 10 includes a first reflection surface section 11*a* and a second reflection surface section 11*b*. The first reflection surface section 11*a* has a shape along a first quadric surface of revolution and has a focal point at a position between the cathode 12 and the anode 13. The second reflection surface section 11*b* is continuous from the first reflection surface section 11*a*, and has a shape along a second quadric surface of revolution. The second reflection surface section 11*b* has a focal point at a position displaced toward the front from the focal point of the first reflection surface section 11*a*.

The first reflection surface section 11*a* may be so formed as to allow a focal point P derived from the first quadric surface of revolution to be substantially coincident with a luminous spot at the time of manufacture of the discharge lamp, i.e., coincident with a luminous spot in early stages of operation of the discharge lamp. On the other hand, the second reflection surface section 11*b* may be so formed as to allow a focal point Q derived from the second quadric surface of revolution to be located at a position corresponding to a tip, following consumption, of the cathode 12.

For example, the first quadric surface of revolution may be defined in cross section by a parabola expressed by $z=0.070_{X1}{}^2$, and the second quadric surface of revolution may be defined in cross section by a parabola expressed by $z=0.069_{X2}{}^2$. The first quadric surface of revolution and the second quadric surface of revolution are common to each other in z axis. The z axis is coincident with an optical axis of the discharge lamp. The $_{X1}$ axis and the $_{X2}$ axis are each unidirectional and perpendicular to the optical axis of the discharge lamp, and the first quadric surface of revolution and the second quadric surface of revolution are different from each other in position of the origin thereof on the optical axis.

The luminous spot of the discharge lamp moves toward a base end of the cathode 12 (moves toward the right in FIG. 1) along the optical axis of the reflection surface 11 with the use over time of the discharge lamp. For example, the luminous spot of the discharge lamp in which an outer diameter of the body 10 is 30 mm or smaller is displaced by about 0.2 mm to 0.3 mm following the elapse of operating time of 500 hours from the early stages of operation. Hence, the focal point Q of the second reflection surface section 11*b* may be preferably located at a position moved from the focal point P of the first reflection surface section 11*a* toward the base end of the cathode 12 along the optical axis of the reflection surface 11 within a range from 0.1 mm to 0.8 mm, more preferably within a range from 0.2 mm to 0.5 mm, for example.

In the reflection surface 11, the second reflection surface section 11*b* may be preferably disposed in front of (i.e., in FIG. 1, located more rightward than) the first reflection surface section 11*a*.

The first reflection surface section 11*a* and the second reflection surface section 11*b* each may be, for example but not limited to, parabolic or elliptical in cross-sectional shape.

The first reflection surface section 11*a* and the second reflection surface section 11*b* each may be formed by, for example but not limited to, a metal vapor-deposition film or a dielectric multilayer film. The metal vapor-deposition film may include, for example but not limited to, silver or aluminum.

Figure 3A:
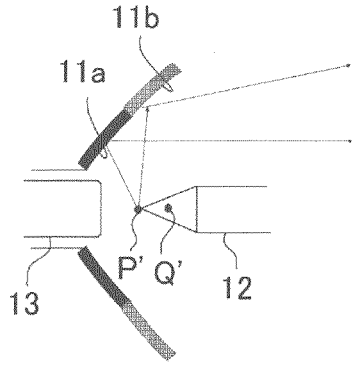
FIG. 3A is a schematic view for describing reflection of light in early stages of operation of the short arc discharge lamp.
Figure 3B:
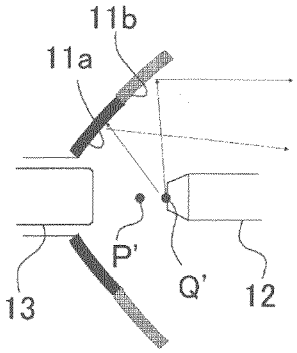
FIG. 3B is a schematic view for describing reflection of light following the elapse of operating time of the short arc discharge lamp.

Referring to FIG. 3A, in the early stages of operation of the discharge lamp, the first reflection surface section 11*a* mainly receives light derived from the luminous spot and reflects therefrom that received light in a form of parallel light, whereas the second reflection surface section 11*b* receives light failed to be applied onto the first reflection surface section 11*a* and reflects therefrom that received light, as a complement to the first reflection surface section 11*a*. On the other hand, in the discharge lamp following the elapse of operating time, the second reflection surface section 11*b* mainly receives the light derived from the luminous spot and reflects therefrom that received light in a form of parallel light, whereas the first reflection surface section 11*a* receives the light failed to be applied onto the second reflection surface section 11*b* and reflects therefrom that received light, as a complement to the second reflection surface section 11*b*, as illustrated in FIG. 3B.

In FIG. 3, P' denotes a position of the luminous spot of the discharge lamp in the early stages of operation, and Q' denotes a position of the luminous spot of the discharge lamp following the elapse of operating time.

The metal block 15 may be made of a material such as, but not limited to, an alloy low in thermal expansion coefficient and high in electric conductivity and heat conductivity, and may have an outer diameter equal to that of the body 10. The alloy of the metal block 15 may mainly contain, for example but not limited to, iron which is low in thermal expansion coefficient and high in electric conductivity and heat conductivity.

The body 10 may be joined, together with the metal block 15, to a second metal tubular body 19 to be fixed to the metal block 15. The second metal tubular body 19 may be cylindrical in shape, and may have the inner diameter that fits in with an outer diameter of the body 10.

For example, the window member 20 may have a disk-like shape, and made of a material which is light-transmissive and low in expansion coefficient, such as, but not limited to, sapphire.

The window member 20 may be supported by a window supporting member 21 such that a circumferential side surface of the window member 20 is brought into contact with an inner circumferential surface of the window supporting member 21 and bonded thereto through a bonding layer. The window supporting member 21 may have a shape of a ring, and may have an inner diameter that fits in with an outer diameter of the window member 20. The window supporting member 21 may be fitted into a metal ring 17 such that an outer circumferential surface of the window supporting member 21 is brought into contact with an inner circumferential surface of the metal ring 17. An end section of the window supporting member 21 may be welded and thus fixed to the metal ring 17. The metal ring 17 may be cylindrical in shape, and may have an inner diameter that fits in with an outer diameter of the window supporting member 21. The metal ring 17 may be made of, for example but not limited to, kovar (Registered Trademark of Carpenter Technology Corporation located in Wyomissing, Pa.).

The metal ring 17 may have an outer diameter equal to the outer diameter of the body 10, and may be joined, together with the body 10, to a first metal tubular body 18. The first metal tubular body 18 may be cylindrical in shape, and may have an inner diameter that fits in with the outer diameter of the body 10. The first metal tubular body 18 may be made of, for example but not limited to, kovar.

With this configuration, air-tightness in the discharge space S is maintained by the window member 20, the window supporting member 21, and the metal ring 17.

Inside the discharge space S is inert gas sealed therein. The inert gas may be, for example but not limited to, xenon gas.

In FIG. 1, a reference numeral 16 denotes a ceramic spacer ring.

The cathode 12 may be a rod-like member including a tapered tip portion having a diameter that decreases as it approaches a tip of the cathode 12. The cathode 12 may be made of a high melting point metal that contains an electron-easily-emissive material, such as, but not limited to, tungsten.

The cathode 12 may be disposed such that the tip portion thereof is opposed to a tip of the anode 13 in the discharge space S, whereas a base end portion of the cathode 12 may be supported by unillustrated three conductive supporting members that may be provided at even intervals on the circumference of the metal ring 17, for example.

The conductive supporting members may be each made of a material such as, but not limited to, molybdenum in view of heat resistance and welding properties, and may be disposed to extend inwardly in a radial direction of the metal ring 17 in the discharge space S. Each of the conductive supporting members may have a tip portion welded to the base end portion of the cathode 12 by a method such as, but not limited to, brazing, and a base end portion fixed to the metal ring 17 by a method such as, but not limited to, brazing.

The cathode 12 is electrically connected to the outside through the conductive supporting members, the metal ring 17, and the first metal tubular body 18.

The anode 13 may be a member having a shape substantially columnar or a shape having a large diameter section and a small diameter section, and may be made of a high melting point metal such as, but not limited to, tungsten.

The anode 13 may be disposed such that a base end portion of the anode 13 is inserted into an electrode rod hole 15H formed on the body 10 and the metal block 15 along an optical axis of the body 10, whereas a tip portion of the anode 13 may be disposed to oppose the cathode 12 in the discharge space S.

The anode 13 is electrically connected to the outside through the metal block 15.

In one embodiment, the discharge lamp may contain the inert gas such as, but not limited to, xenon that may be filled in the discharge space S at tens of atmospheric pressure, and may have a rated current of 18 ampere and power consumption of 250 watts to 350 watts.

Non-limiting examples as to dimensions of the discharge lamp in one embodiment may include: 20 mm for an overall length of the body 10 and 32 mm for an outer diameter thereof; 15 mm for an overall length of the cathode 12, 1.5 mm for a rod diameter thereof, 1.6 mm for a length of a tapered section of the tip thereof, and 50 degrees for a taper angle of the tip thereof; 24 mm for an overall length of the anode 13 and 4 mm for a diameter thereof; 1.4 mm for an inter-electrode distance between the anode 13 and the cathode 12; the first reflection surface section 11*a* has the shape, at a portion defined by $_{X1}$=4 mm to 8 mm, along the first quadric surface of revolution whose cross section is defined by a parabola expressed by $z=0.070_{X1}{}^2$, and has the focal point P coincident with a luminous spot at the time of manufacture of the discharge lamp; the second reflection surface section 11*b* has the shape, at a portion defined by $_{X2}$=8 mm to 10 mm, along the second quadric surface of revolution whose cross section is defined by a parabola expressed by $z=0.069_{X2}{}^2$, and has the focal point Q coincident with a position moved from the focal point at the time of manufacture of the discharge lamp toward the base end of the cathode 12 along the optical axis by 0.2 mm; and 24.89 mm for an outer diameter of the window member 20 and 3 mm for a thickness thereof.

In the discharge lamp according to the present embodiment of the invention, the reflection surface 11 of the body 10 includes the first reflection surface section 11*a* and the second reflection surface section 11*b*. The first reflection surface section 11*a* has the focal point P at a position between the cathode 12 and the anode 13, and the second reflection surface section 11*b* has the focal point Q at a position displaced toward the front from the focal point P of the first reflection surface section 11*a*. Thus, following the shift of the luminous spot from the focal point P of the first reflection surface section 11*a* with the elapse of operating time of the discharge lamp, the displaced luminous spot is brought into coincidence with the focal point Q of the second reflection surface section 11*b*. Hence, the first reflection surface section 11*a* mainly receives the light derived from the luminous spot in the early stages of operation of the discharge lamp, and the second reflection surface section 11*b* mainly receives the light derived from the luminous spot with the elapse of operating time of the discharge lamp, making it possible to suppress variation in the illuminance that decreases with the elapse of operating time of the discharge lamp. In this regard, a description is provided below based on a comparison between the discharge lamp according to the present embodiment and that illustrated in FIG. 5.

Figure 5:
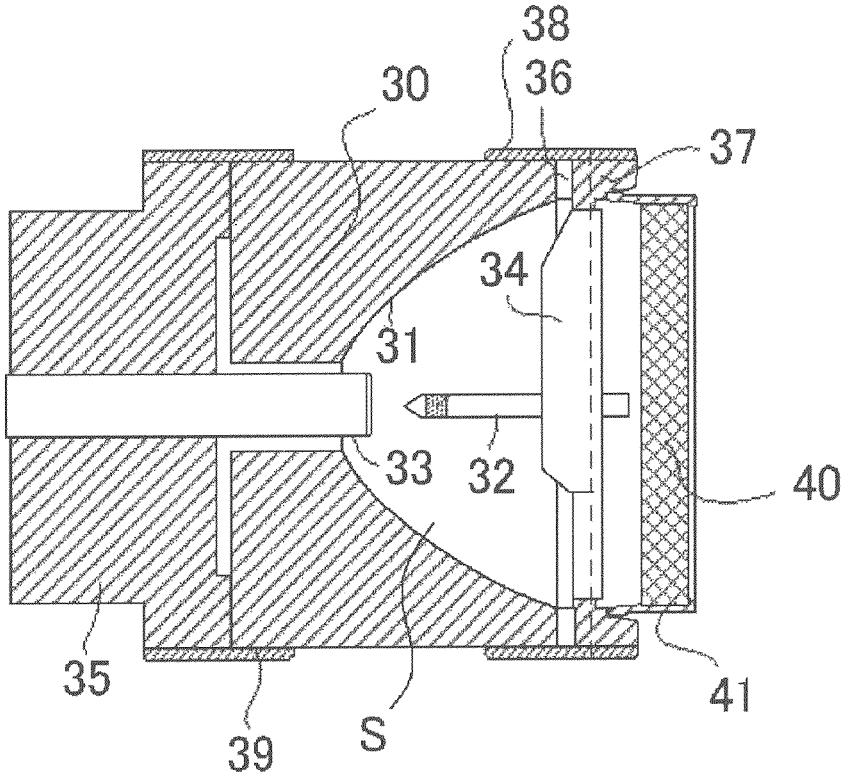
FIG. 5 is a cross-sectional view for describing an example of a configuration of a short arc discharge lamp.

In the discharge lamp having the configuration as illustrated in FIG. 5, illuminance decreases with the elapse of operating time as compared with illuminance in early stages of operation of the discharge lamp. Presumably, this is largely due to the following two phenomena.

One of the phenomena is that deposition, resulting inevitably from evaporation and emission derived from the cathode 32 and the anode 33 in the discharge space S of the discharge lamp, occurs with the elapse of operating time on the reflection surface 31 and the window member 40.

The other phenomenon is as follows. In the early stages of operation of the discharge lamp, the focal point of the reflection surface is located at the gap between the cathode and the anode, thus allowing for sufficient reception of the light derived from the luminous spot. However, due to evaporation of the tip of the cathode with the use of the discharge lamp over time and consequential shortening of the cathode, the position of the luminous spot is displaced inevitably toward the base end of the cathode with the elapse of operating time, thus making it difficult for the reflection surface to receive the light derived from the luminous spot sufficiently. Hence, this phenomenon causes the variation in illuminance with the use of the discharge lamp over time.

The two phenomena as described above occur concurrently, bringing about on a greater scale a reduction in quantity of light resulting from the decrease in illuminance with the elapse of operating time.

The decrease in illuminance attributed to the latter phenomenon occurs especially in a discharge lamp in which the luminous spot and the reflection surface are brought close to each other, and hardly occurs in a discharge lamp whose reflection surface is provided outside the discharge space or in a discharge lamp, despite being of a built-in mirror type, in which a diameter of the body is large and the luminous spot and the reflection surface are distant from each other. However, in a discharge lamp having a built-in mirror in which a diameter of the body is equal to or smaller than 30 mm, the latter phenomenon occurs even by the shortening of the cathode by only 0.1 mm.

In contrast, in the discharge lamp according to the present embodiment of the invention, the reflection surface 11 of the body 10 includes the first reflection surface section 11*a* having the focal point P and the second reflection surface section 11*b* having the focal point Q as described above. Thus, the first reflection surface section 11*a* mainly receives the light derived from the luminous spot in the early stages of operation of the discharge lamp, and the second reflection surface section 11*b* mainly receives the light derived from the luminous spot with the elapse of operating time of the discharge lamp. Hence, it is possible to suppress the variation in the illuminance that decreases with the elapse of operating time of the discharge lamp.

Also, in one embodiment where the second reflection surface section 11*b* is disposed in front of the first reflection surface section 11*a*, the first reflection surface section 11*a* is located consequently at a position closer to the tip of the cathode 12 and where a greater quantity of light is thus applied. Hence, it is possible to ensure enough illuminance in the early stages of operation of the discharge lamp.

Although the invention has been described in the foregoing by way of example with reference to some example embodiments, the invention is not limited thereto but may be modified in a wide variety of ways.

For example, the reflection surface includes the two reflection surface sections each having the shape along the quadric surface of revolution and having different focal points from each other on the optical axis in the example embodiment described above. However, this is non-limiting and the reflection surface in one embodiment may include three or more reflection surface sections each having a shape along a quadric surface of revolution and having different focal points from one another on the optical axis.

Furthermore, the invention encompasses any possible combination of some or all of the various embodiments described herein and incorporated herein.

EXAMPLES

In the following, specific Examples of the discharge lamp are described. It should be understood that these Examples are illustrative, and should not be construed as being limiting in any way.

Example 1

A short arc discharge lamp having the following specifications was manufactured, based on the configuration illustrated in FIGS. 1 and 2.

Body (body 10): made of polycrystalline alumina ($Al_2O_3$), 20 mm in overall length and 32 mm in outer diameter.

First reflection surface section (first reflection surface section 11*a*): had the shape, at a portion defined by $_{X1}$=4 mm to 8 mm, along the first quadric surface of revolution whose cross section was defined by a parabola expressed by $z=0.070_{X1}{}^2$.

Second reflection surface section (second reflection surface section 11*b*): had the shape, at a portion defined by $_{X2}$=8 mm to 10 mm, along the second quadric surface of revolution whose cross section was defined by a parabola expressed by $z=0.069_{X2}{}^2$. A distance from the focal point (focal point Q) derived from $z=0.069_{X2}{}^2$ to the focal point (focal point P) of the first reflection surface section (first reflection surface section 11*a*) was 0.2 mm.

Cathode (cathode 12): made of thoriated tungsten, 1.5 mm in rod diameter, 14.8 mm in overall length, 1.6 mm in length of the tapered section of the tip, and 50 degrees in taper angle of the tip.

Anode (anode 13): made of tungsten, 4 mm in diameter and 23.4 mm in overall length.

Inter-electrode distance between the anode (anode 13) and the cathode (cathode 12): 1.4 mm.

Sealed gas: xenon gas at pressure of 1.93 MPa (in 25 degrees centigrade).

Window member (window member 20): made of sapphire, 24.89 mm in outer diameter, 3 mm in thickness.

Window supporting member (window supporting member 21): made of kovar (Registered Trademark of Carpenter Technology Corporation).

Comparative Example 1

A short arc discharge lamp was manufactured that had the same configuration and specifications as those of the Example 1, with the exception that a body having a reflection surface, parabolic in shape as a whole and whose focal point was located at a luminous spot in early stages of operation, was used instead of the body having the reflection surface including the first reflection surface section and the second reflection surface section illustrated in FIG. 2.

An operating test was conducted in which the discharge lamp according to the Example 1 and that according to the comparative example 1 were each operated, while measuring a quantity of light on an evaluation surface, for 500 hours under the conditions of power of 252 watts and a voltage of 14 volts both in the early stages of operation of the discharge lamps. Results thereof are as shown in the following Table and FIG. 4.

Figure 4:
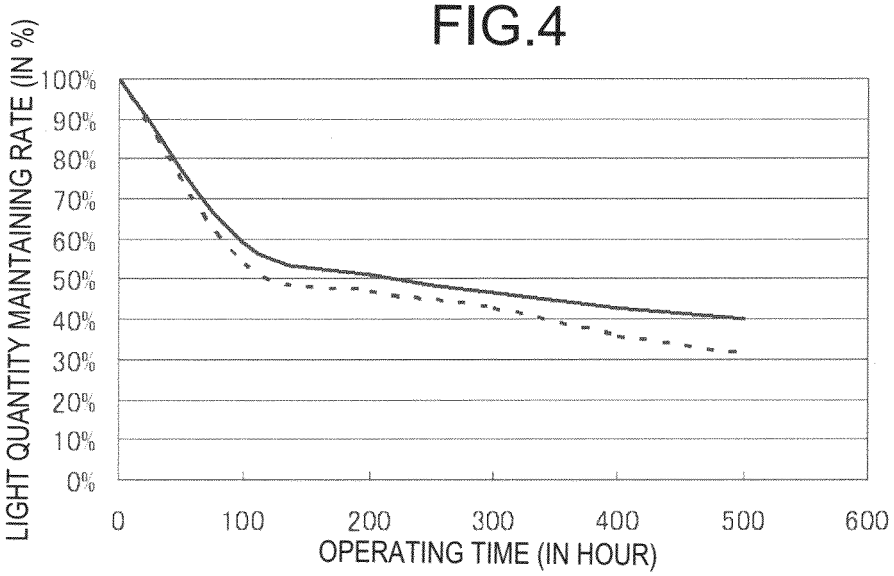
FIG. 4 is a graph showing a maintaining rate of illumination versus operating time of the short arc discharge lamp.

In the Table and FIG. 4, a quantity of light (illumination) in the early stages of the discharge lamp according to the comparative example 1 is defined as 100 (a.u.). Also, in the graph shown in FIG. 4, the quantity of light (illumination) in the early stages of each of the discharge lamps is defined as 100%, and a maintaining rate of illumination in the discharge lamp according to the Example 1 and that in the discharge lamp according to the comparative example 1 are denoted by a solid line and a dashed line, respectively.

The evaluation surface was a circular surface that had a diameter of 0.8 mm and was present coaxially with an optical axis of the reflection surface (the reflection surface 11) and away from a surface of the window member (the window member 20) by 105 mm with a condenser lens provided in between.

TABLE

| | Maintaining Rate of Illumination | |
|---|---|---|
| | Zero Hour | 500 Hours |
| Example 1 | 100 (a.u.) | 40.2 (a.u.) |
| Comparative Example 1 | 100 (a.u.) | 31.2 (a.u.) |

As is evident from the results shown in the Table and FIG. 4, it was confirmed that the discharge lamp in the Example 1 was higher than the discharge lamp in the comparative example 1 in the maintaining rate of illumination at 500 hours of operation, i.e., it was confirmed that the discharge lamp in the Example 1 suppressed the variation between the illuminance in the early stages of operation and the illuminance following the elapse of operating time.

It is possible to achieve at least the following configurations from the above-described example embodiments of the invention.

(1) A short arc discharge lamp, including:

a body including therein a reflection surface and having a front opening, the reflection surface being curved in a concave shape and including a first reflection surface section and a second reflection surface section, the first reflection surface section having a shape along a first quadric surface of revolution, and the second reflection surface section having a shape along a second quadric surface of revolution;

a cathode and an anode that are opposed to each other in discharge space, the discharge space being defined by the reflection surface surrounding the discharge space; and a window member provided in front of the body and covering the front opening, the first reflection surface section having a focal point at a position between the cathode and the anode, and the second reflection surface section being continuous from the first reflection surface section, and having a focal point at a position displaced toward front from the focal point of the first reflection surface section.

(2) The short arc discharge lamp according to (1), wherein the focal point of the second reflection surface section is located at the position corresponding to a consumed tip of the cathode.

(3) The short arc discharge lamp according to (1) or (2), wherein the second reflection surface section is disposed in front of the first reflection surface section.

(4) The short arc discharge lamp according to any one of (1) to (3), wherein the body is configured of an insulating member.

(5) The short arc discharge lamp according to any one of (1) to (4), wherein the focal point of the first reflection surface section is substantially coincident with a luminous spot upon manufacture of the short arc discharge lamp.

(6) The short arc discharge lamp according to any one of (1) to (5), wherein the first reflection surface section has a first parabolic cross-sectional shape, and the second reflection surface section has a second parabolic cross-sectional shape different from the first parabolic cross-sectional shape.

(7) The short arc discharge lamp according to any one of (1) to (5), wherein the first reflection surface section has a first elliptical cross-sectional shape, and the second reflection surface section has a second elliptical cross-sectional shape different from the first elliptical cross-sectional shape.

Although the invention has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A short arc discharge lamp, comprising:

a body that includes a reflection surface and a front opening, the reflection surface is curved in a concave shape and includes a first reflection surface section and a second reflection surface section, the first reflection surface section has a shape along a first quadric surface of revolution, the second reflection surface section has a shape along a second quadric surface of revolution;

a window member that covers the front opening, a discharge space that is defined by the reflection surface and the window member that surrounds the discharge space and where inert gas is sealed;

a cathode and an anode that are opposed to each other being directly surrounded by the discharge space: wherein the first reflection surface section has a first focal point at a first position between the cathode and the anode; and the second reflection surface section is continuous from the first reflection surface section and has a second focal point at a second position displaced toward front from the first focal point.

2. The short arc discharge lamp according to claim 1, wherein the second position is located at a consumed tip of the cathode.

3. The short arc discharge lamp according to claim 1, wherein the second reflection surface section is disposed in front of the first reflection surface section.

4. The short arc discharge lamp according to claim 1, wherein the body is configured of an insulating member.

5. The short arc discharge lamp according to claim 2, wherein the first position is substantially coincident with a luminous spot upon manufacture of the short arc discharge lamp.

6. The short arc discharge lamp according to claim 1, wherein the first reflection surface section has a first parabolic cross-sectional shape, and the second reflection surface section has a second parabolic cross-sectional shape different from the first parabolic cross-sectional shape.

7. The short arc discharge lamp according to claim 1, wherein the first reflection surface section has a first elliptical cross-sectional shape, and the second reflection surface section has a second elliptical cross-sectional shape different from the first elliptical cross-sectional shape.

* * * * *